US009500195B2

(12) United States Patent
Blume

(10) Patent No.: US 9,500,195 B2
(45) Date of Patent: Nov. 22, 2016

(54) INTEGRATED DESIGN FLUID END SUCTION MANIFOLD

(71) Applicant: George H Blume, Austin, TX (US)

(72) Inventor: George H Blume, Austin, TX (US)

( * ) Notice: Subject to any disclaimer, the term of this patent is extended or adjusted under 35 U.S.C. 154(b) by 223 days.

(21) Appl. No.: 14/078,366

(22) Filed: Nov. 12, 2013

(65) Prior Publication Data

US 2014/0137963 A1 May 22, 2014

Related U.S. Application Data

(60) Provisional application No. 61/727,289, filed on Nov. 16, 2012.

(51) Int. Cl.

| | |
|---|---|
| ***F04B 53/16*** | (2006.01) |
| ***F04B 9/109*** | (2006.01) |
| ***F04B 23/06*** | (2006.01) |
| ***F04B 53/10*** | (2006.01) |

(52) U.S. Cl.

CPC ..... *F04B 53/16* (2013.01); *F04B 9/1095* (2013.01); *F04B 23/06* (2013.01); *F04B 53/10* (2013.01); *Y10T 137/86083* (2015.04)

(58) Field of Classification Search

CPC ..... F04B 9/109; F04B 9/1095; F04B 15/04; F04B 23/06; F04B 53/16

USPC ..... 417/62, 521, 568, 557, 273

See application file for complete search history.

(56) References Cited

U.S. PATENT DOCUMENTS

| | | | | |
|---|---|---|---|---|
| 2,366,814 | A | 1/1945 | Smith | |
| 3,146,724 | A | 9/1964 | Davidson | |
| 4,032,265 | A | 6/1977 | Miller | |
| 4,129,324 | A | 12/1978 | Jones, Jr. | |
| 4,445,829 | A | 5/1984 | Miller | |
| 4,456,440 | A | 6/1984 | Korner | |
| 4,512,368 | A | 4/1985 | Kaminaka et al. | |
| 4,585,400 | A | 4/1986 | Miller | |
| 4,712,578 | A | 12/1987 | White | |
| 5,311,904 | A | 5/1994 | Beppu | |
| 5,334,352 | A | 8/1994 | Johnson | |
| 5,474,102 | A | 12/1995 | Lopez | |
| 5,575,262 | A | 11/1996 | Rohde | |
| 5,765,814 | A | 6/1998 | Dvorak et al. | |
| 5,960,827 | A | 10/1999 | Rosenberg | |
| 6,418,909 | B2 | 7/2002 | Rossi et al. | |
| 7,506,574 | B2 * | 3/2009 | Jensen | F04B 53/007 417/454 |
| 7,621,728 | B2 | 11/2009 | Miller | |
| 2002/1018660 | | 8/2002 | Braun et al. | |
| 2010/0322803 | A1 * | 12/2010 | Small | F04B 53/16 417/454 |

* cited by examiner

*Primary Examiner* — Devon Kramer
*Assistant Examiner* — Chirag Jariwala
(74) *Attorney, Agent, or Firm* — Gary W. Hamilton

(57) ABSTRACT

A fluid end assembly comprising a housing, valve bodies, seals, seats, springs, and other associated parts, paired with a suction manifold that facilitates bi-directional fluid flow. The suction manifold of this invention is designed to preserve fluid energy that will ensure complete filling of the cylinder in extreme pumping conditions. The suction manifold utilizes a chamber design positioned immediately below the suction valves, eliminating all connecting ducts. Alternate embodiments of this invention include a suction manifold with an integral fluid dampeners or stabilizers.

4 Claims, 14 Drawing Sheets

Enlarged Area "B-B" of Figure 6A

Enlarged Area "B-B" of Figure 6A

Section "C-C' of Figure 6A

Section "D-D" of Figure C

Section "B-B" of Figure 8A

INTEGRATED DESIGN FLUID END SUCTION MANIFOLD

RELATED APPLICATION DATA

This Patent Application claims priority to Provisional Patent Application No. 61/727,289, filed on Nov. 16, 2012, which, by this reference is incorporated for all purposes.

FIELD OF THE INVENTION

The invention generally concerns high-pressure plunger-type pumps useful, for example, in oil well hydraulic fracturing. More specifically, the invention relates to pump suction manifolds designed to properly feed suction valves utilized in rapid open-close cycling when pumping abrasive fluids, such as sand slurries at high pressures.

BACKGROUND OF THE INVENTION

Engineers typically design high-pressure oil field plunger pumps in two sections; the (proximal) power section and the (distal) fluid section which are connected by multiple stay-rods. The power section, illustrated in FIG. 1, usually comprises a crankshaft, reduction gears, bearings, connecting rods, crossheads, crosshead extension rods, etc. Commonly used fluid sections usually comprise a plunger pump housing having a suction valve in a suction bore, a discharge valve in a discharge bore, an access bore, and a plunger in a plunger bore, plus high-pressure seals, retainers, etc. FIG. 1 illustrates a typical fluid section showing its connection to a power section by stay rods. A plurality of fluid cylinders similar to that illustrated in FIG. 1 may be combined, as suggested in the Quini-plex or five cylinder fluid section housing illustrated in FIG. 1. Fluid sections also include a suction manifold to supply fluid to the suction bore and suction valve. The suction manifold is typically attached to the fluid section by bolts. The suction manifold is typically connected to external piping used to supply fluid to the manifold by a tubular connection on either end of the suction manifold. The discharge manifold which allows for the exit of the pumped high pressure fluid is usually integral to the fluid section.

Valve terminology varies according to the industry (e.g., pipeline or oil field service) in which the valve is used. In some applications, the term "valve" means just the valve body, which reversibly seals against the valve seat. In other applications, the term "valve" includes components in addition to the valve body, such as the valve seat and the housing that contains the valve body and valve seat. A valve as described herein comprises a valve body and a corresponding valve seat, the valve body typically incorporating an elastomeric seal within a peripheral seal retention groove.

Valves can be mounted in the fluid end of a high-pressure pump incorporating positive displacement pistons or plungers in multiple cylinders. Such valves typically experience high pressures and repetitive impact loading of the valve body and valve seat. These severe operating conditions have in the past often resulted in leakage and/or premature valve failure due to metal wear and fatigue. In overcoming such failure modes, special attention is focused on valve sealing surfaces (contact areas) where the valve body contacts the valve seat intermittently for reversibly blocking fluid flow through a valve.

Valve sealing surfaces are subject to exceptionally harsh conditions in exploring and drilling for oil and gas, as well as in their production. For example, producers often must resort to "enhanced recovery" methods to insure that an oil well is producing at a rate that is profitable. And one of the most common methods of enhancing recovery from an oil well is known as fracturing. During fracturing, cracks are created in the rock of an oil bearing formation by application of high hydraulic pressure. Immediately following fracturing, a slurry comprising sand and/or other particulate material is pumped into the cracks under high pressure so they will remain propped open after hydraulic pressure is released from the well. With the cracks thus held open, the flow of oil through the rock formation toward the well is usually increased.

The industry term for particulate material in the slurry used to prop open the cracks created by fracturing is the propend. And in cases of very high pressures within a rock formation, the propend may comprise extremely small aluminum oxide spheres instead of sand. Aluminum oxide spheres may be preferred because their spherical shape gives them higher compressive strength than angular sand grains. Such high compressive strength is needed to withstand pressures tending to close cracks that were opened by fracturing. Unfortunately, both sand and aluminum oxide slurries are very abrasive, typically causing rapid wear of many component parts in the positive displacement plunger pumps through which they flow. Accelerated wear is particularly noticeable in plunger seals and in the suction (i.e., intake) and discharge valves of these pumps.

Back pressure tends to close each individual valve sequentially when downstream pressure exceeds upstream pressure. For example, back pressure is present on the suction valve during the pump plunger's pressure stroke (i.e., when internal pump pressure becomes higher than the pressure of the intake slurry stream. During each pressure stroke, when the intake slurry stream is thus blocked by a closed suction valve, internal pump pressure rises and slurry is discharged from the pump through a discharge valve. For a discharge valve, back pressure tending to close the valve arises whenever downstream pressure in the slurry stream (which remains relatively high) becomes greater than internal pump pressure (which is briefly reduced each time the pump plunger is withdrawn as more slurry is sucked into the pump through the open suction valve).

The suction manifold plays a vital role in the smooth operation of the pump and valve performance and life. All fluid entering the pump passes through the suction manifold. If the suction manifold is poorly designed, incomplete filling of the cylinder may result, which in turn leads to valves closing well after the end of the suction stroke, which in turn results in higher valve impact loads. High valve impact loads in turn result in high stress in the fluid end housing and ultimate premature failure of the valves, seats, and/or housing.

To insure complete filling of the cylinder requires fluid energy in the suction manifold and fluid energy in the cylinder during the suction stroke. The pumped fluid typically acquires fluid energy from the fluid pressure from a small supercharging pump immediately upstream from the pump of this invention. The fluid energy can be dissipated by turbulence or friction within the suction filling plumbing or line and in the suction manifold. Thus the design of the suction manifold is critical to maintaining fluid energy. Fracturing pumps typically pump a very heavy and viscous fluid as the fluid is composed of heavy sand suspended in a gel type fluid. With this type of fluid it is very easy to lose fluid energy to friction and/or turbulence.

A traditional design Suction Manifold is illustrated in FIGS. 2A and 2B. The fluid end sectional view of FIG. 2B is defined in FIG. 2A. An alternate sectional view at a right angle to the sectional view of FIG. 2B is illustrated in FIG. 3B; this sectional view is defined in FIG. 3A. Sharp corners at the intersection of the horizontal main chamber and the vertical suction valve feed ducts result in turbulence and loss of fluid energy. The manifold of this design is a bi-directional flow design.

Zoomie style suction manifolds illustrated in FIGS. 4 and 5, have gained some acceptance in the industry. By intuition, it is incorrectly assumed that that the long sweep ell style ducts reduce turbulence and that the flow in the manifold is uni-directional. However because each suction valve opens and closes at different intervals, flow is actually interrupted when the valve is closed. Furthermore flow is reversed momentarily as the valve closes. When flow reverses, turbulence is generated at the sharp corner positioned at the intersection of the main suction manifold chamber and the ell that functions as a duct for feeding the corresponding suction valve. When the flow stops in a portion of the manifold, some fluid energy is lost and fluid energy is expended to resume flow when the suction valve opens. In addition there is considerable frictional loss in the long sweep ell ducts that the pumped fluid must travel through resulting in even greater loss of fluid energy within the Zoomie style suction manifold.

SUMMARY OF THE INVENTION

The present invention continues the integrated design approach utilized by the inventor in previous patent applications. The present invention utilizes a plenum chamber suction manifold design without ducts utilized in a traditional suction manifold. The suction manifold of the present invention allows for bi-directional flow in the manifold and significantly reduces friction and turbulence while maintaining fluid energy. In the plenum chamber design of this invention, the entire suction manifold is located directly below the fluid end block, eliminating all vertical ducts used to feed the suction valves. The plenum chamber design replaces ducts with ports concentric with the suction valves and allows fluid to be fed directly to the suction valve. The suction manifold of the present invention is attached to the bottom of the fluid housing by bolts and a mounting flange located across the top of the chamber. The circumferential edges of the duct-less ports have full radii equal to the thickness of the mounting flange. The radiused edge allows bi-direction flow in the manifold and eliminates turbulence at the suction manifold ports.

High fluid energy is essential in maintaining complete filling of the cylinder during the suction stroke. Incomplete filling of the cylinder results in the suction valve closing well past the end of the suction stroke which in turn causes high valve impact loads and associated high stresses on the valve seat and fluid end.

The present invention presents a counter-intuitive approach to the zoomie style suction manifolds in that the present invention allows for bi-directional fluid flow with minimum turbulence and frictional fluid drag.

An alternate embodiment of this invention allows for an integral suction dampener or stabilizer to be installed internal to the suction manifold. Most traditional suction stabilizers have a gas charge which is contained in a bladder inside the stabilizer housing, said stabilizer being positioned externally, upstream from the suction manifold of the pump. In the alternate embodiment of this invention the gas bladder is positioned inside the suction manifold. The gas charge is obviously more compressible than the liquid being pumped and provides a capacitance or spring effect which in turn will absorb the pulsation created by the abrupt flow change as the pump suction valves open and close. During the suction stroke of the pump, each plunger stroke must overcome the inertia of the columns of fluid in the suction manifold ducts. At the end of each stroke, this inertia must again be overcome to bring the fluid columns to rest. Devastating damage may occur in the suction piping as a result of fluid cavitation. One common cause of fluid cavitation that can be easily remedied is acceleration head losses in the suction piping causing the Net Positive Suction Head (NPSH) available to fall below the value required for the pump. NPSH is the difference between the total pressure on the inlet side of the pump less the vapor pressure of the liquid and the friction losses of the suction pipe work. If there is insufficient NPSH, the suction stroke of the pump may cause the fluid pressure to fall below the vapor pressure of the process fluid causing local boiling of the fluid and producing vapor bubbles which come out of solution. Once the pressure increases again, the bubbles collapse producing pressure waves of high intensity. These pressure waves are extremely damaging to the interior of the pump fluid section and the valves and seats contained therein.

Recently cellulous bladders have replaced gas bladders in some applications; in cellulous bladders, the gas is entrapped within closed cells inside a near solid elastomer bladder. An elastomeric cellulous bladder consists of millions of nitrogen filled micro-cells, which are compressible to absorb pressure variations. Cellulous bladders have the advantage of being maintenance free in that the gas does not require routine maintenance by charging with replacement gas. Gas bladder style stabilizers require routine charging to maintain the required pressure for efficient performance. Because gas bladders seek a circular shape when pressurized, gas bladders require simple geometric cross sections such as circles or ellipses. A gas bladder with a circular cross section would have a cylindrical volume. Multiple gas bladders can be installed to increase the overall volume of the dampener/stabilizer.

A disadvantage of cellulous bladders is that cellulous bladders require more volume than gas bladders because of the volume elastomers surrounding each closed cell. Fortunately this disadvantage is offset because cellulous bladders constructed of elastomeric materials can be molded into complex shapes and thus the overall exterior dimensions can be designed to be similar to the exterior dimensions of gas bladder stabilizers.

For optimum performance, the suction dampener or stabilizer should be located as close to the suction valve of the fluid section as possible. The duct-less design of the present invention allows for the optimum placement of the suction dampener or stabilizer in very close proximity of the suction valve.

DETAILED DESCRIPTION

Figure 1:
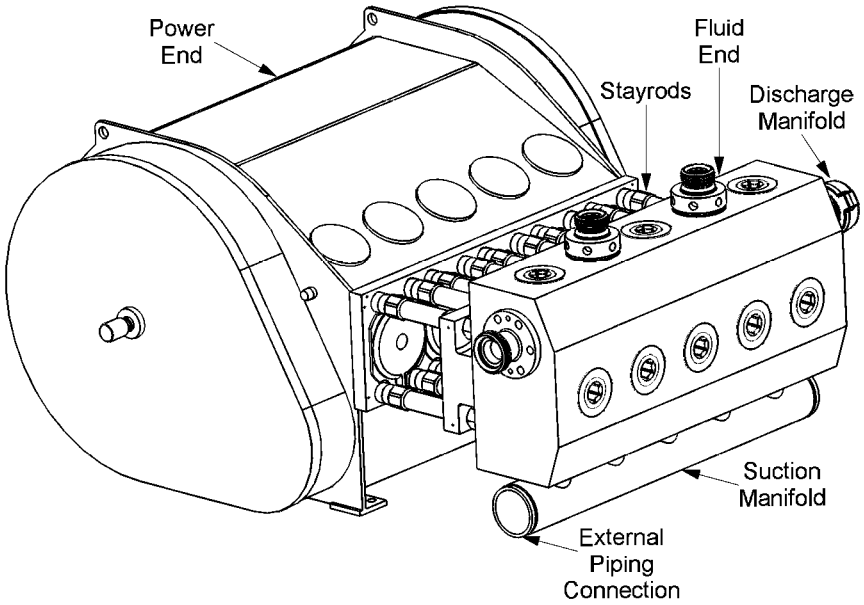
FIG. 1 is an exterior orthogonal view of a typical plunger pump showing the power end section and the fluid section with the two ends connected by stay rods. A typical suction manifold is also illustrated.
Figure 2A:
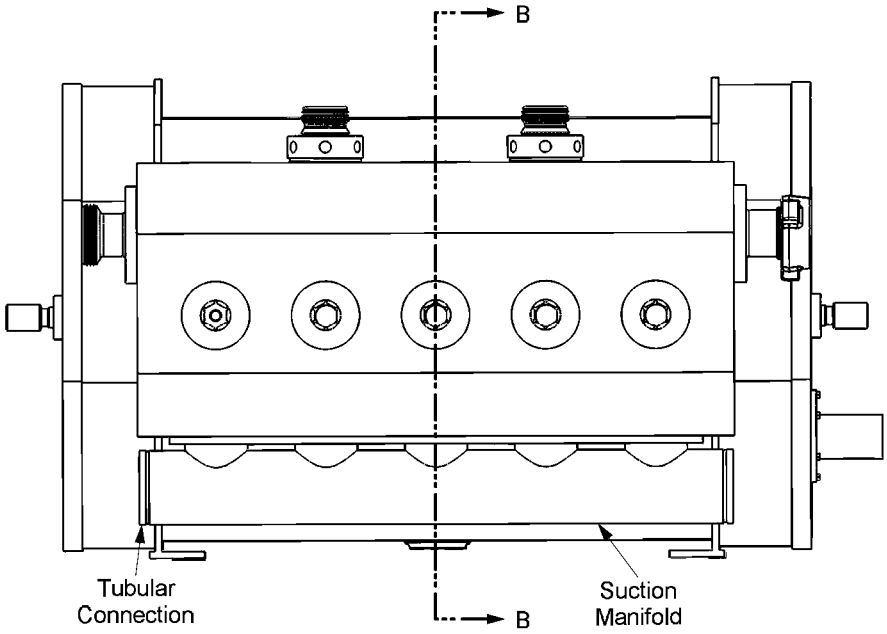
FIG. 2A is an exterior view of a typical plunger pump; view is taken looking toward the fluid end and suction manifold of the pump.
Figure 2B:
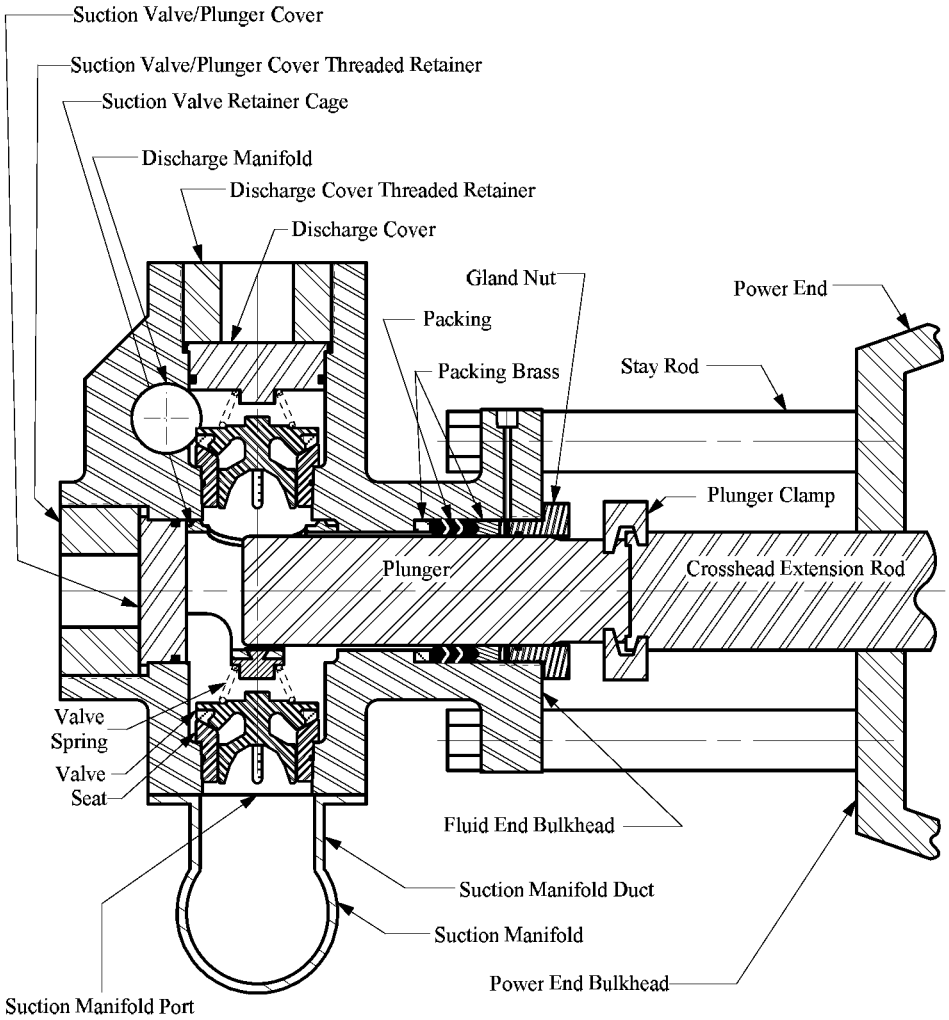
FIG. 2B schematically illustrates cross-section B-B of a typical high-pressure pump and suction manifold of FIG. 2A.
Figure 3A:
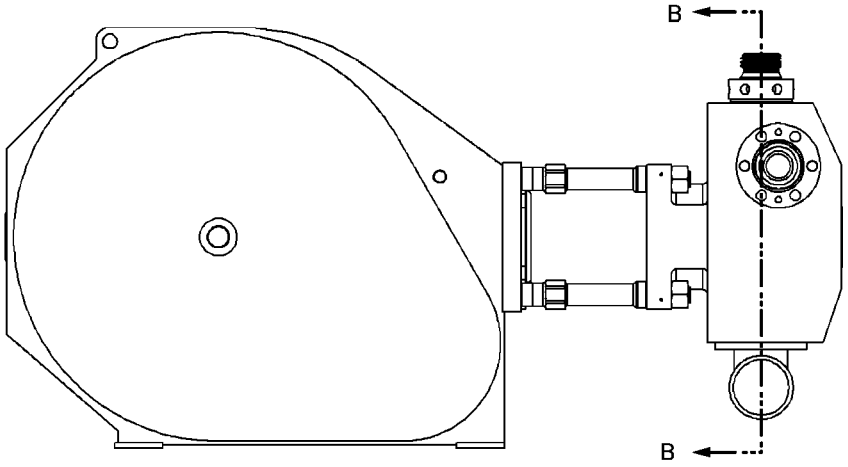
FIG. 3A is an exterior side view of a typical plunger pump.
Figure 3B:
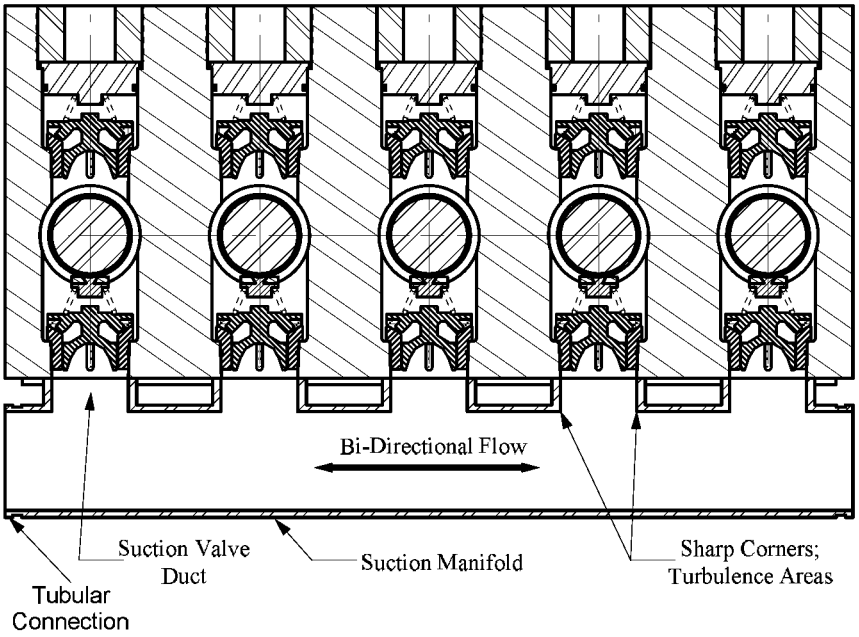
FIG. 3B schematically illustrates cross-section B-B of a typical high-pressure pump and suction manifold of FIG. 3A.
Figure 4:
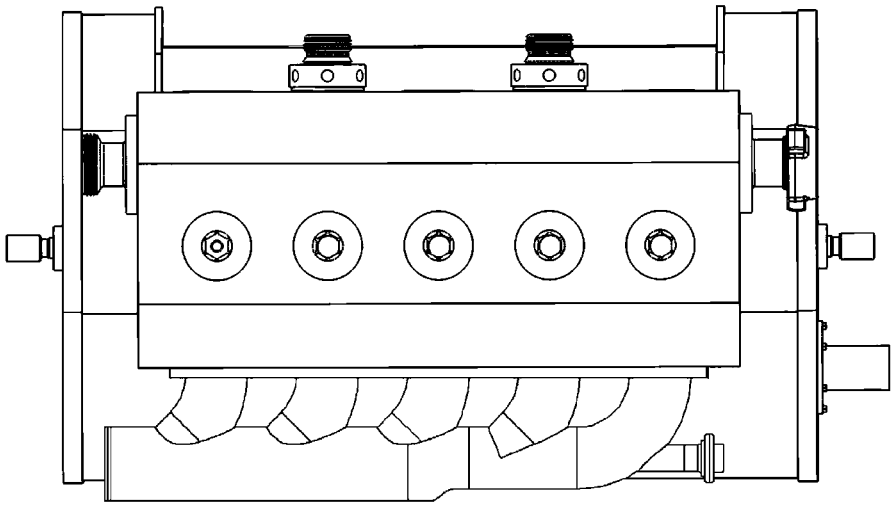
FIG. 4 schematically illustrates an end view from the fluid end of a typical high-pressure pump similar to view of FIG. 2A with the alternate zoomie style suction manifold.
Figure 5:
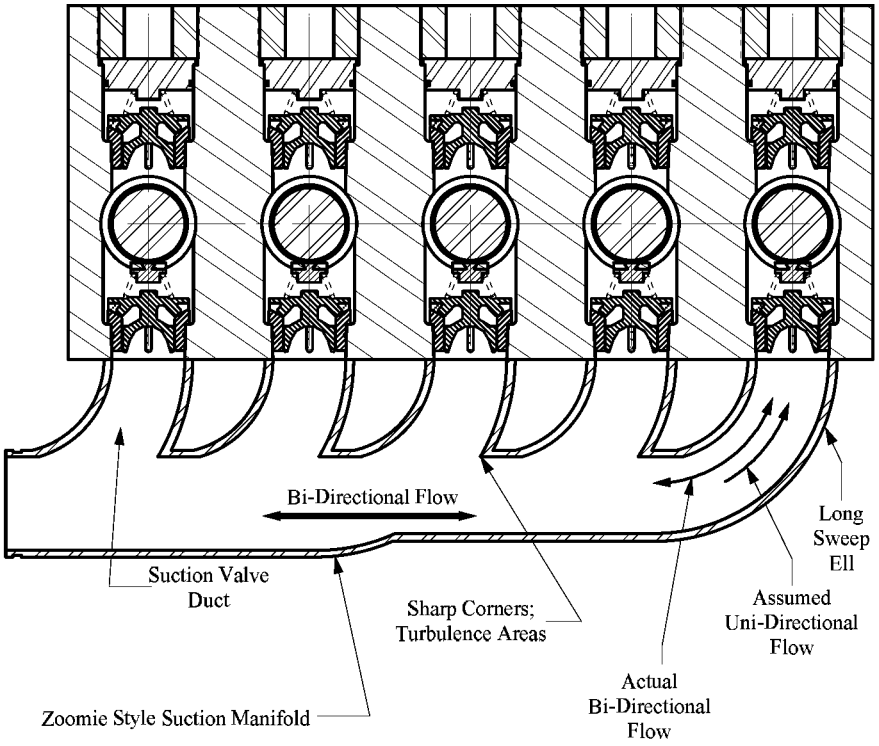
FIG. 5 schematically illustrates cross-section of a typical high-pressure pump and zoomie style suction manifold of FIG. 4
Figure 6A:
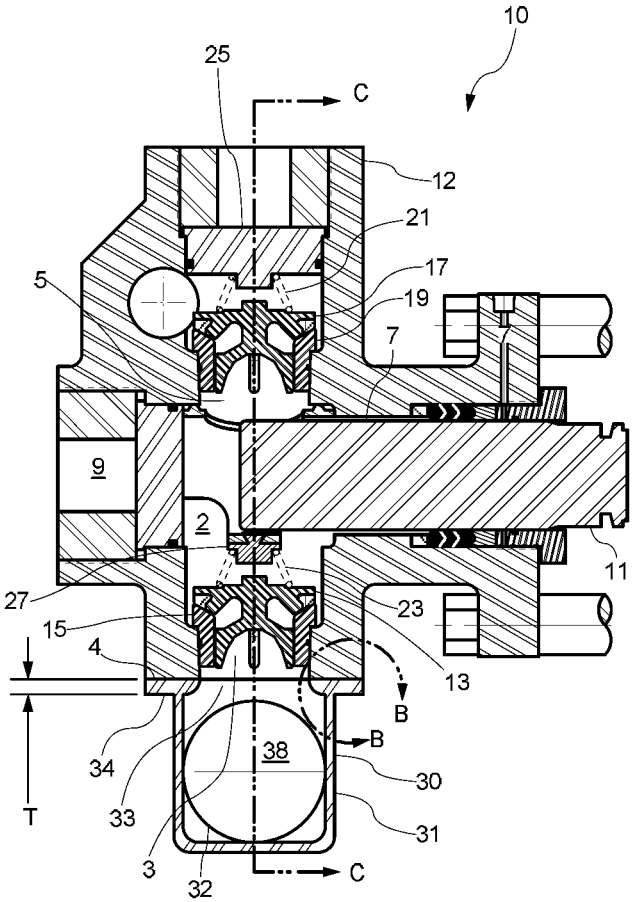
FIG. 6A schematically illustrates a cross-sectional view through one cylinder of a typical high-pressure pump and suction manifold of the present invention.

FIG. 6A schematically illustrates a cross-sectional view through one cylinder of a typical high-pressure pump and suction manifold of the present invention. The cross-section illustrated of pump fluid section 10 is perpendicular to the axes of the suction valve bore 3, discharge bore 5, access bore 9, and plunger bore 7. FIG. 6A illustrates a plunger pump fluid section 10 made using a housing 12, and having suction valve bore 3, discharge bore 5, access bore 9 suction valve 13, seat 15, discharge valve 17, seat 19, plunger 11 present in a plunger bore 7, inner volume 2, suction valve spring 23, suction valve spring retainer 27, discharge valve spring 21, discharge cover and spring retainer 25 according to some embodiments of the disclosure. In FIG. 6A the springs and retainers function to provide a mechanical bias to the suction valve and discharge valve, towards a closed position. FIG. 6A illustrates a suction manifold 30 of the present invention, comprising exterior walls 31 of an undefined shape and substantially tubular sections 32 located at either or both ends of the suction manifold 30. Tubular section 32 is utilized to connect the suction manifold 30 to external piping with a corresponding tubular configuration utilized for supplying fluid to the pump fluid section 10. Suction manifold 30 also comprises a mounting flange 34 usually attached to the fluid end housing 12 with bolts (not shown.) Suction manifold mounting flange 34 mates with the bottom surface 4 of fluid end housing 12. Suction manifold mounting flange 34 has a thickness T. Suction manifold 30 also contains multiple ports 33 located concentric to corresponding suction valve 13 and suction seat 15. The number of ports in the suction manifold 30 is equal to the number of suction valves 13 in the pump fluid section 10. Suction manifold central chamber 38 is utilized to distribute fluid to ports 33.

Figure 6B:
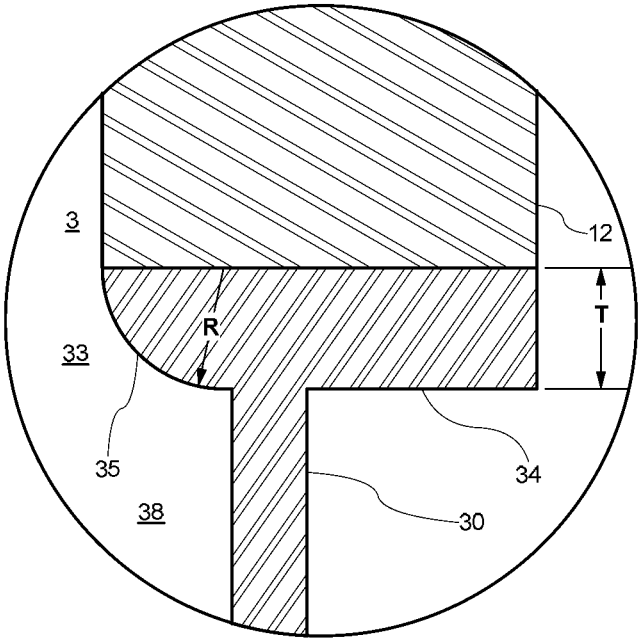
FIG. 6B schematically illustrates an enlargement of area B-B of the suction manifold of FIG. 6A.

FIG. 6B schematically illustrates an enlargement of area B-B of the suction manifold 30 of FIG. 6A. Suction manifold 30 has mounting flange 34 and a port 33 to facilitate transfer of pumped fluid from the suction suction manifold central chamber 38 into the suction valve bore 3 of fluid end housing 12 and then through the suction valve 13 and seat 15. Central passage Suction manifold central chamber 38 is utilized to distribute fluid to ports 33. Circumferential edge 35 of the port 33 is radiused with radius R; radius R is approximately equal to mounting flange 34 thickness T.

Figure 6C:
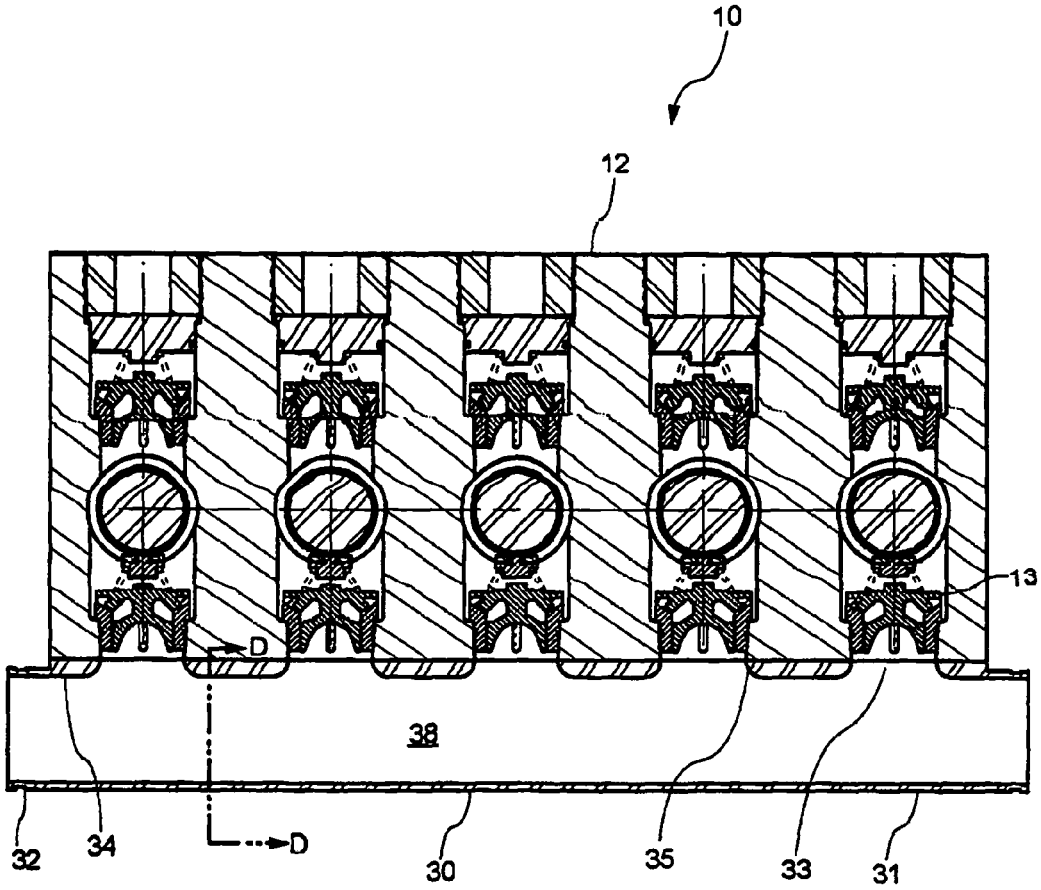
FIG. 6C schematically illustrates cross-section C-C of the fluid end and suction manifold of FIG. 6A.
Figure 6D:
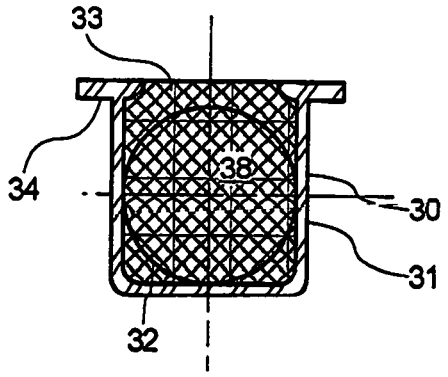
FIG. 6D schematically illustrates cross-section D-D of the fluid end and suction manifold of FIG. 6C.

FIG. 6C schematically illustrates cross-section C-C of the fluid end and suction manifold 30 of FIG. 6A. The cross-section of FIG. 6C is transverse across all cylinders of the housing 12 of the pump fluid section 10. FIG. 6B illustrates a suction manifold 30 of the present invention, comprising exterior walls 31 of an undefined shape and substantially tubular sections 32 located at either or both ends of the suction manifold 30. Tubular section 32 is utilized to connect the suction manifold 30 to external piping supplying fluid to the pump fluid section 10. Suction manifold 30 also comprises a mounting flange 34 usually attached to the fluid end housing 12 with bolts (not shown.) Suction manifold 30 also contains multiple ports 33 located concentric to corresponding suction valve 13. The number of ports in the suction manifold 30 being equal to the number of suction valves 13 in the pump fluid section. The circumferential edge 35 of each port 33 is machined with a radius R that is approximately equal to the thickness T of the mounting flange 34. Suction dampener central chamber 38 is utilized to distribute fluid to ports 33.

Figure 7:
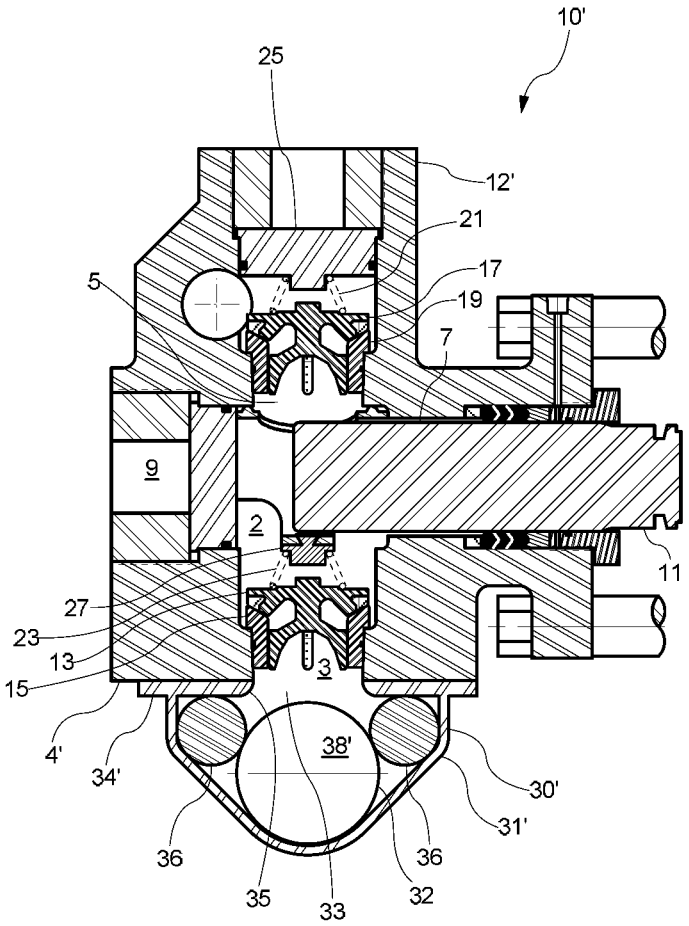
FIG. 7 schematically illustrates a cross-sectional view through one cylinder of a typical high-pressure pump and suction manifold of the present invention with multiple integral gas bladder fluid dampeners.

FIG. 7 schematically illustrates an alternate embodiment of the suction manifold of the present invention with one or more integral gas bladder dampeners or stabilizers 36. FIG. 7 illustrates a plunger pump fluid section 10' made using a housing 12', and having suction valve bore 3, discharge bore 5, access bore 9 suction valve 13, seat 15, discharge valve 17, seat 19, plunger 11 present in a plunger bore 7, inner volume 2, suction valve spring 23, suction valve spring retainer 27, discharge valve spring 21, discharge cover and spring retainer 25 according to some embodiments of the disclosure. In FIG. 7 the springs and retainers function to provide a mechanical bias to the suction valve and discharge valve, towards a closed position.

FIG. 7 illustrates a suction manifold 30' of the present invention, comprising exterior walls 31' of an undefined shape and substantially tubular sections 32 located at either or both ends of the suction manifold 30'. Tubular section 32 is utilized to connect the suction manifold 30' to external piping with a corresponding tubular configuration utilized for supplying fluid to the pump fluid section 10'. Suction manifold 30' also comprises a mounting flange 34' usually attached to the fluid end housing 12' with bolts (not shown.) Suction manifold mounting flange 34' mates with the bottom surface 4' of fluid end housing 12'. Suction manifold mounting flange 34' has thickness T. Suction manifold 30' also contains multiple ports 33 located concentric to corresponding suction valve 13. The number of ports in the suction manifold 30' being equal to the number of suction valves 13 in the pump 10'. Suction Manifold 30' contains one or more integral fluid stabilizers or dampeners 36 positioned internal to the suction manifold wall 31'. Fluid stabilizer 36 is of the gas bladder type being cylindrical is shape. Suction manifold 30' is dimensionally larger than suction manifold 30 of FIG. 6A due to the inclusion of the one or more fluid stabilizers 36. Due to the larger size of manifold 30' mounting flange 34' and fluid end housing bottom surface 4' have greater width than similar surfaces in FIG. 6A. Fluid stabilizers 36 are located to allow unobstructed fluid passage through the manifold 30'. In the preferred embodiment fluid stabilizers 36 are positioned near mounting flange 34' in close proximity to the ports 33.

As shown in FIG. 7, manifold 30 has mounting flange 34' and multiple ports 33 to facilitate transfer of pumped fluid from the suction manifold 30' into the suction valve bore 3 of fluid end housing 12' and then through the suction valve 13 and seat 15. Circumferential edge 35 of the port 33 is radiused with radius R; radius R is approximately equal to mounting flange 34' thickness T, similarly illustrated in FIG. 6B. Suction manifold central chamber 38' is utilized to distribute fluid to ports 33.

Figure 8A:
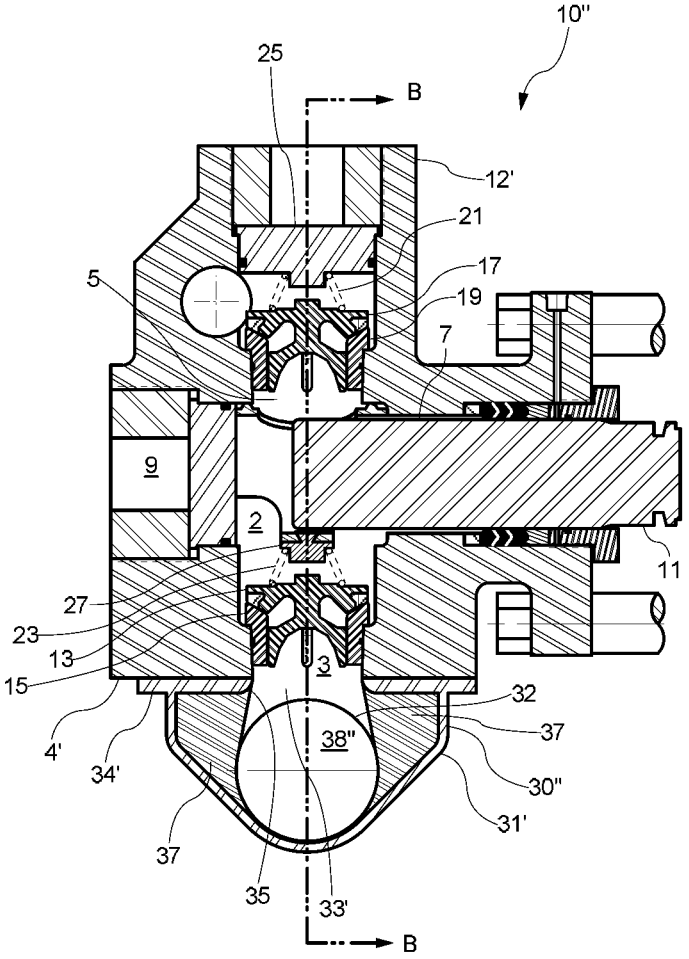
FIG. 8A schematically illustrates a cross-sectional view through one cylinder of a typical high-pressure pump and suction manifold of the present invention with an integral cellulous suction fluid dampener.

FIG. 8A schematically illustrates another alternate embodiment of the suction manifold of the present invention with an integral cellulous bladder stabilizer constructed with a cellulous bladder versus the gas bladder of FIG. 7. FIG. 8A illustrates a plunger pump fluid section 10" made using a housing 12', and having suction valve bore 3, discharge bore 5, access bore 9 suction valve 13, seat 15, discharge valve 17, seat 19, plunger 11 present in a plunger bore 7, inner volume 2, suction valve spring 23, suction valve spring retainer 27, discharge valve spring 21, discharge cover and spring retainer 25 according to some embodiments of the disclosure. In FIG. 8A the springs and retainers function to provide a mechanical bias to the suction valve and discharge valve, towards a closed position.

FIG. 8A illustrates a suction manifold 30" of the present invention, comprising exterior walls 31', tubular sections 32, multiple ports 33', mounting flange 34', and radiused circumferential edge 35 which are identical or nearly identical to corresponding features of FIG. 7. Fluid end housing 12' and bottom surface 4' are also similar to corresponding features in FIG. 7. Suction manifold central chamber 38" is utilized to distribute fluid to ports 33'.

Suction Manifold 30", FIG. 8A, contains one or more integral fluid stabilizers or dampeners 37 positioned internal to the suction manifold wall 31'. Fluid stabilizers 37 are positioned to allow unobstructed fluid passage through the manifold 30". In the preferred embodiment fluid stabilizers 37 are positioned near the mounting flange 34' in close proximity to the ports 33'. Suction manifold 30" of FIG. 8A utilizes multiple closed cell cellulous bladders 37 as opposed to gas bladders in suction manifold 30' of FIG. 7. Unlike gas bladder stabilizers 36 in FIG. 7, cellulous bladders stabilizers 37 can be molded with irregular or complex cross sections to optimize performance of the stabilizers 37.

Figure 8B:
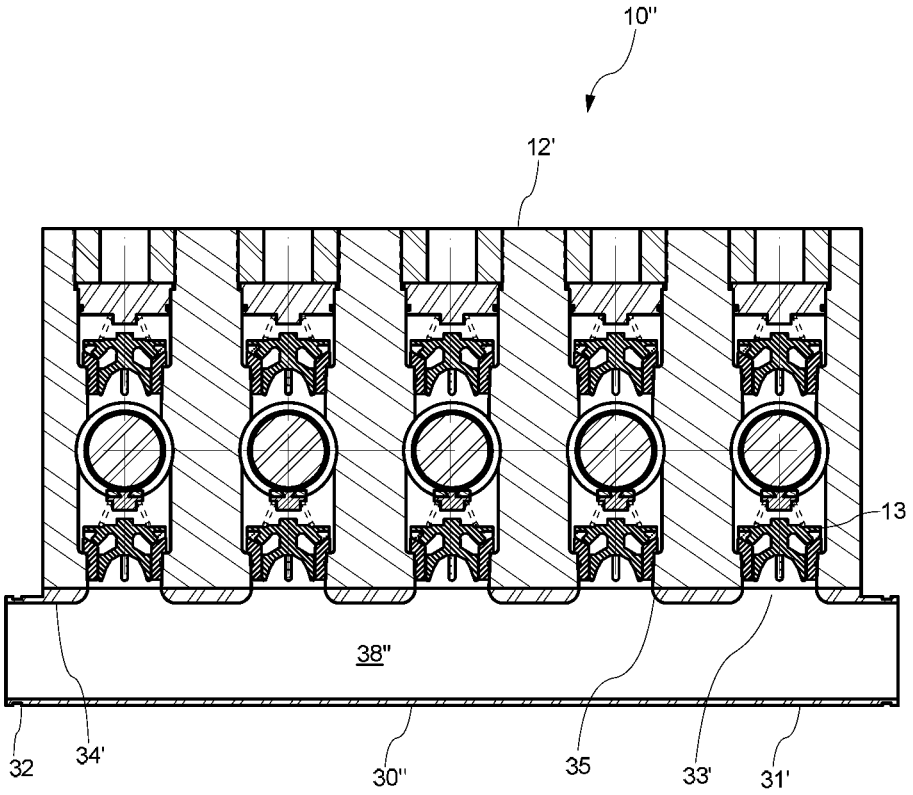
FIG. 8B schematically illustrates cross-section B-B of the fluid end and suction manifold with integral cellulous fluid dampener of FIG. 8A.

FIG. 8B schematically illustrates cross-section B-B of the fluid end and suction manifold 30" of FIG. 8A. The cross-section of FIG. 8B is transverse across all cylinders of the housing 12' of the pump fluid section 10". FIG. 8B illustrates a suction manifold 30" of the present invention, comprising exterior walls 31' of an undefined shape and substantially tubular sections 32 located at either or both ends of the suction manifold 30". Suction manifold 30" also comprises a mounting flange 34' usually attached to the fluid end housing 12' with bolts (not shown.) Suction manifold 30" also contains ports 33' located concentric to corresponding suction valve 13. The number of ports in the suction manifold 30" being equal to the number of suction valves 13 in the pump 10". The circumferential edge 35 of each port 33' is a radius R that is equal approximately to the thickness T of the mounting flange 34', similarly illustrated in FIG. 6B. Suction dampener central chamber 38" is utilized to distribute fluid to ports 33'.

What is claimed is:

1. A pump fluid end and a suction manifold of a design that is located immediately below a plurality of suction valves in said pump fluid end and preserves fluid energy, comprising:

wherein said suction manifold has a plurality of ports equal to the number of individual suction valves in said plurality of suction valves, wherein each port in said plurality of ports feeds directly from a suction chamber into a corresponding suction valve bore without connecting ducts, wherein said suction manifold is constructed with a flat top surface and said surface also functions as a mounting flange, wherein said suction manifold purls pass through said mounting flange; and wherein circumferential edges of said ports are radiused with a radius approximately equal to a thickness of said mounting flange.

2. A pump fluid end, comprising:

a plurality of suction valves;

a suction manifold comprising a plenum chamber, said suction manifold located immediately below said plurality of suction valves;

wherein said suction manifold comprises a plurality of ports and wherein the number of ports in said plurality of ports is equal to the number of individual suction valves in said plurality of suction valves;

wherein said each port in said plurality of ports feed directly from a suction central chamber into a respective bore in each individual suction valve in said plurality of suction valves;

wherein said suction manifold is constructed with a flat top surface and said surface defining a mounting flange;

wherein said mounting flange is in direct fluid communication with said suction central chamber;

wherein said individual ports in said plurality of ports between said suction valves and said manifold central chamber are wholly contained within said mounting flange; and wherein circumferential edges of said individual ports in said plurality of ports are radiused or chamfered.

3. The pump fluid end of claim 2, wherein the circumferential edges of said individual ports in said plurality of ports are radiused with a radius or chamfered approximately equal to a thickness of said mounting flange.

4. The pump fluid end of claim 2, wherein said plenum chamber is larger in cross-section than a tubular section at either end of said suction manifold.

* * * * *